US010480826B2

(12) United States Patent
Paine

(10) Patent No.: US 10,480,826 B2
(45) Date of Patent: Nov. 19, 2019

(54) SYSTEM AND METHOD OF CONTROLLING A MIXING VALVE OF A HEATING SYSTEM

(71) Applicant: LOCHINVAR, LLC, Lebanon, TN (US)

(72) Inventor: John Charles Paine, Brentwood, TN (US)

(73) Assignee: LOCHINVAR, LLC, Lebanon, TN (US)

( * ) Notice: Subject to any disclaimer, the term of this patent is extended or adjusted under 35 U.S.C. 154(b) by 191 days.

(21) Appl. No.: 15/595,033

(22) Filed: May 15, 2017

(65) Prior Publication Data

US 2017/0328599 A1 Nov. 16, 2017

Related U.S. Application Data

(60) Provisional application No. 62/336,138, filed on May 13, 2016.

(51) Int. Cl.

| | |
|---|---|
| ***F24H 9/20*** | (2006.01) |
| ***F24D 19/10*** | (2006.01) |
| *F24H 1/10* | (2006.01) |

(52) U.S. Cl.

CPC ..... *F24H 9/2028* (2013.01); *F24D 19/1051* (2013.01); *F24H 1/10* (2013.01); *F24H 1/102* (2013.01); *F24H 9/2007* (2013.01); *F24H 9/2014* (2013.01)

(58) Field of Classification Search

CPC ..... F24H 9/2028; F24H 1/10; F24H 1/102; F24H 9/2014; F24H 9/2007; F24D 3/105; F24D 3/18; F24D 19/1051

See application file for complete search history.

(56) References Cited

U.S. PATENT DOCUMENTS

| | | | | |
|---|---|---|---|---|
| 4,542,849 A * | 9/1985 | Pichot | F24D 12/02 | 236/1 EB |
| 4,852,524 A * | 8/1989 | Cohen | F24H 1/285 | 122/448.1 |
| 5,655,710 A * | 8/1997 | Kayahara | F24D 12/02 | 122/448.3 |
| 6,694,926 B2 * | 2/2004 | Baese | F23D 14/02 | 122/14.2 |
| 7,506,617 B2 * | 3/2009 | Paine | F23N 1/082 | 122/448.3 |

(Continued)

*Primary Examiner* — Matthew W Jellett
(74) *Attorney, Agent, or Firm* — Michael Best & Friedrich LLP

(57) ABSTRACT

A fluid heating system including a fluid supply subsystem having a fluid heating device, a fluid output subsystem, and an intermediary fluid device. The fluid heating system also includes a control device for the fluid supply subsystem, a first temperature sensor, a second temperature sensor, and a control circuit coupled to the control device. The control device is configured to control one selected from a group consisting of the fluid heating device and an amount of water input to the intermediary fluid device. The first and second temperature sensors are configured to output first and second temperature signals, respectively. The control circuit is configured to generate a first control signal based on the second temperature signal, determine a multiplier, generate a second control signal based on the first temperature signal, and send a main control signal to the control device based on the first and second control signals.

17 Claims, 9 Drawing Sheets

(56) References Cited

U.S. PATENT DOCUMENTS

| | | | | |
|---|---|---|---|---|
| 7,819,334 | B2 * | 10/2010 | Pouchak | F23N 5/00 122/448.1 |
| 9,797,614 | B2 * | 10/2017 | Kato | F24F 3/06 |
| 9,851,110 | B2 * | 12/2017 | Hayashida | F24D 3/18 |
| 9,945,587 | B2 * | 4/2018 | Lowrimore | F24H 4/02 |
| 9,951,962 | B2 * | 4/2018 | Tamaki | F24D 3/18 |
| 2017/0023263 | A1 * | 1/2017 | Tamaki | F24D 3/08 |
| 2018/0023818 | A1 * | 1/2018 | Takayama | F24H 1/00 62/238.6 |
| 2018/0156511 | A1 * | 6/2018 | Chikami | F24H 4/02 |

* cited by examiner

SYSTEM AND METHOD OF CONTROLLING A MIXING VALVE OF A HEATING SYSTEM

RELATED APPLICATIONS

The present application claims priority to U.S. Provisional Patent Application No. 62/336,138, filed on May 13, 2016, the entire contents of which are hereby incorporated.

FIELD

Embodiments relate to water heaters.

SUMMARY

Tankless, or instantaneous, water heaters may include a heat exchanger to heat water for consumer use. Regulating the temperature of the water provided to the consumer includes regulating the amount of water from a heating loop entering the heat exchanger. Providing an appropriate amount of water from the heating loop to the heat exchanger may be difficult when the temperature of a cold water inlet varies with, for example, outdoor temperature.

In one embodiment, the application provides a fluid heating system including a fluid supply subsystem having a fluid heating device, a fluid output subsystem, and an intermediary fluid device. The intermediary fluid device is coupled to the fluid supply subsystem and the fluid output subsystem. The intermediary fluid device includes a first input configured to receive fluid from the fluid output subsystem, a first output configured to output fluid to the fluid output subsystem, a second input configured to receive fluid from the fluid supply subsystem, and a second output configured to output fluid to the fluid output subsystem. The fluid heating system also includes a control device for the fluid supply subsystem, a first temperature sensor, a second temperature sensor, and a control circuit coupled to the control device. The control device is configured to control one selected from a group consisting of the fluid heating device and an amount of water input to the intermediary fluid device. The first temperature sensor is configured to output a first temperature signal indicative of an input temperature at the first input of the intermediary fluid device, and the second temperature sensor is configured to output a second temperature signal indicative of an output temperature at the first output of the intermediary fluid device. The control circuit is coupled to the control device, the first temperature sensor, and the second temperature sensor. The control circuit is configured to generate a first control signal based on the second temperature signal, determine a multiplier based on the second temperature signal, generate a second control signal, separate from the first control signal, based on the multiplier and the first temperature signal, and send a main control signal to the control device based on the first control signal and the second control signal. The control device is configured to receive the main control signal, and change operation of the control device according to the main control signal.

In another embodiment, the application provides a method of controlling a fluid heating system. The method includes receiving, fluid from a fluid output subsystem at a first input of an intermediary fluid device, receiving fluid from a fluid supply subsystem at a second input of the intermediary fluid device, the fluid supply subsystem including a fluid heating device, outputting fluid to the fluid output subsystem at a first output of the intermediary fluid device, and outputting fluid to the fluid supply subsystem at a second output of the intermediary fluid device. The method also includes receiving, at a control circuit, a first temperature signal from a first temperature sensor, receiving, at the control circuit, a second temperature signal from the second temperature sensor. The first temperature signal is indicative of an input temperature at the first input of the intermediary fluid device. Analogously, the second temperature signal is indicative of an output temperature at the first output of the intermediary fluid device. The method further includes generating, with the control circuit, a first control signal based on the second temperature signal, determining, with the control circuit, a multiplier based on the second temperature signal, and generating, with the control circuit, a second control signal, separate from the first control signal, based on the multiplier and the first temperature signal. The method also includes sending a main control signal to a control device for the fluid supply subsystem based on the first control signal and the second control signal, and changing operation of the control device in response to receiving the main control signal at the control device. The control device controls one selected from a group consisting of the fluid heating device and an amount of water input to the intermediary fluid device.

Other aspects of the application will become apparent by consideration of the detailed description and accompanying drawings.

DETAILED DESCRIPTION

Before any embodiments of the application are explained in detail, it is to be understood that the application is not limited in its application to the details of construction and the arrangement of components set forth in the following description or illustrated in the following drawing. The application is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
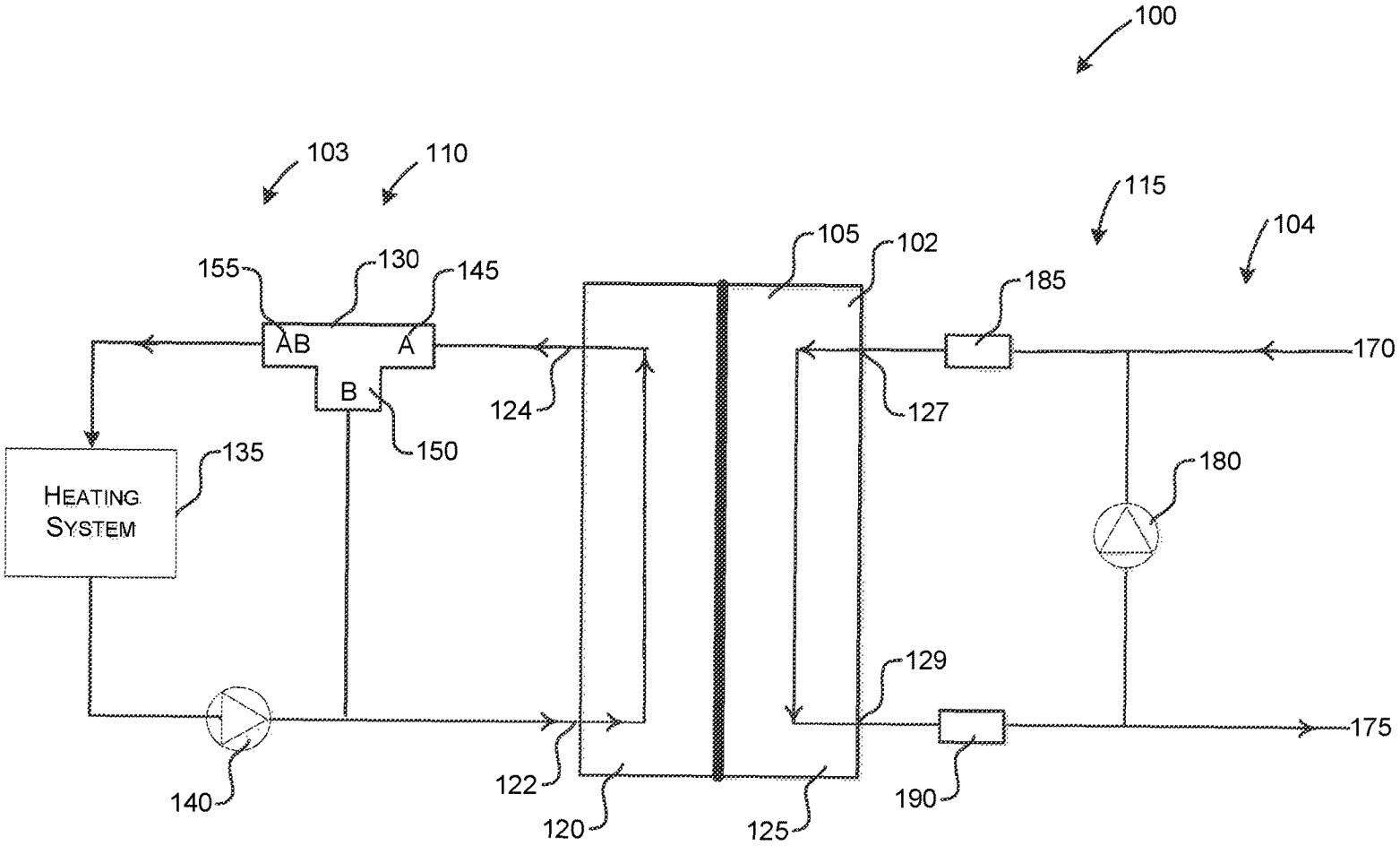
FIG. 1 is a schematic diagram of a water heating system according to some embodiments of the application.

FIG. 1 is a diagram of a water heating system 100 according to some embodiments of the application. The water heating system 100 includes an intermediary device 102, a water supply subsystem 103, and a water output subsystem 104. In the illustrated embodiment, the intermediary device 102 corresponds to a heat exchanger 105, the water supply subsystem 103 corresponds to a heating loop 110, and the water output subsystem 104 corresponds to an output loop 115. In the illustrated embodiment, the water heating system 100 may be, for example, a commercial or domestic tankless hot water heater. The heat exchanger 105 includes a first portion 120 and a second portion 125. The first portion 120 receives water from the heating loop 110, while the second portion 125 receives water from the output loop 115. The first portion 120 includes a first inlet 122 and a first outlet 124. Water from the heating loop 110 is received at the first inlet 122 and output at the first outlet 124 back into the heating loop 110. The second portion 125 includes a second inlet 127 and a second outlet 129. Cold inlet water is received at the second inlet 127 and hot water, for use by a consumer, is output from the second outlet 129. The heat exchanger 105 transfers heat from the water of the heating loop 110 to the water of the output loop 115 to provide hot water to a consumer.

The heating loop 110 includes a mixing valve 130, a heating system 135 (for example, or heating device), and a pump 140. In some instances, the mixing valve 130 may also be referred to as a control device for the heating loop 110. In the illustrated embodiment, the mixing valve 130 is a three-way valve that controls how much water from the heating loop 110 enters the heat exchanger 105. Controlling the amount of water that enters the heat exchanger 105 helps maintain the water of the output loop 115 at a setpoint temperature. The mixing valve 130 includes a first valve inlet 145, a second valve inlet 150, and a valve outlet 155. The first valve inlet 145 is coupled to the first outlet 124 of the heat exchanger 105 and thus receives the water from the heating loop 110 that has been circulated through the heat exchanger 105. The second valve inlet 150 is coupled between the pump 140 and the first inlet 122 of the heat exchanger 105 and thus receives water that is diverted from entering the heat exchanger 105, and is instead recirculated through the heating loop 110. The valve outlet 155 of the mixing valve 130 is coupled to the heating system 135 and circulates the water received from the first outlet 124 of the heat exchanger 105 and/or the water diverted from the first inlet 122 of the heat exchanger 105 toward the heating system 135. The mixing valve 130 is movable between positions to change the amount of water that is diverted from the first inlet 122 of the heat exchanger 105 and thereby controls how much water from the heating loop 110 enters the heat exchanger 105.

The heating system 135 includes components that heat the water in the heating loop 110. The heating system 135 may include, for example, boilers, heat pumps, electric water heaters, and the like. The heating system 135 receives the water from the mixing valve 130, heats the water, and outputs the hot water to the pump 140. The pump 140 circulates the heating loop water toward the heat exchanger 105 continuously. As discussed above, the water propelled by the pump 140 may enter the heat exchanger 105 through the first inlet 122 of the heat exchanger 105, or may be diverted away from the heat exchanger 105 toward the second valve inlet 150 of the mixing valve 130.

Figure 2A:
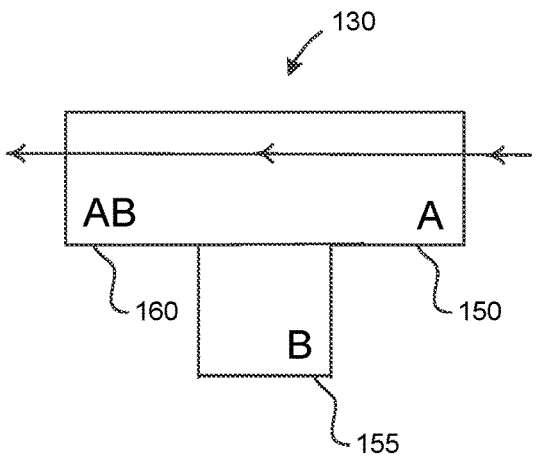
FIGS. 2A-2C are diagrams of a three-way valve of the water heating system of FIG. 1 in different positions.
Figure 2B:
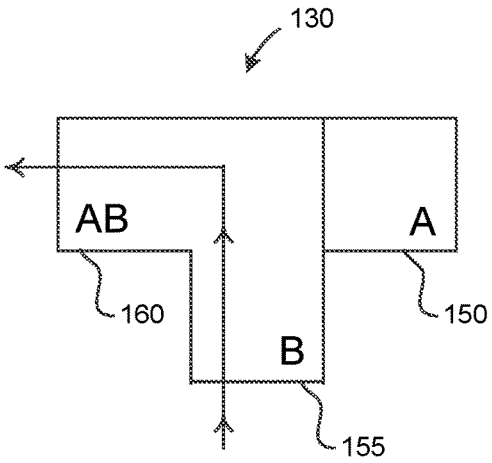
Figure 2C:
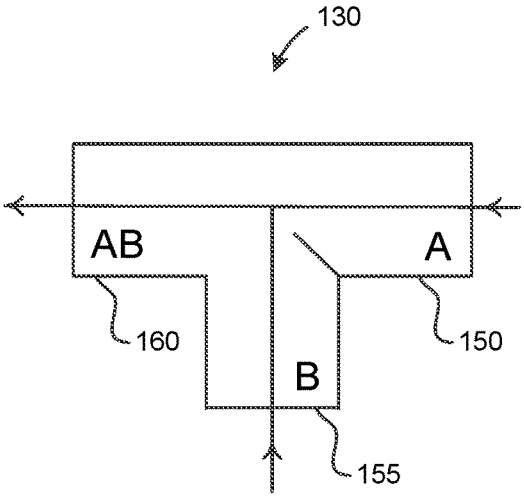

FIGS. 2A-2C illustrate diagrams of different positions of the mixing valve 130. For example, FIG. 2A illustrates a first position of the mixing valve 130 in which the second valve inlet 150 of the mixing valve 130 is closed. In the first position, the mixing valve 130 receives water only through the first outlet 124 of the heat exchanger 105. When the mixing valve 130 is in the first position, all of the water from the heating loop 110 is directed to the heat exchanger 105, processed by the heat exchanger 105, and released by the heat exchanger 105 to the mixing valve 130. The mixing valve 130 may be in the first position when, for example, there is a high demand for hot water and thus more heat is necessary at the first portion 120 of the heat exchanger 105. FIG. 2B, on the other hand, illustrates a second position of the mixing valve 130 in which the first valve inlet 145 of the mixing valve 130 is closed. In the second position, the mixing valve 130 receives only the water that is diverted from the first inlet 122 of the heat exchanger 105. When the mixing valve 130 is in the second position, the water from the heating loop 110 does not enter the heat exchanger 105, and the heat exchanger 105 does not receive heat at the first portion 120. The mixing valve 130 may be in the second position when, for example, there is no demand for hot water and no heat is necessary at the heat exchanger 105 to maintain the domestic water at the setpoint temperature. FIG. 2C illustrates a third position of the mixing valve 130 in which both the first valve inlet 145 and the second valve inlet 150 are open. In the third position, the mixing valve 130 receives water from the first outlet 124 of the heat exchanger 105 and water that is diverted from the first inlet 122 of the heat exchanger 105. The mixing valve 130 may change between more than the three positions illustrated by FIGS. 2A-C. For example, the first valve inlet 145 and/or the second valve inlet 150 may be partially opened, and do not need to be fully opened or fully closed. The first valve inlet 145 and/or the second valve inlet 150 may change between different positions while remaining partially opened. Such movement of the mixing valve 130 provides a gradual change in the mixing valve 130 and provides better control of the amount of water from the heating loop 110 entering the heat exchanger 105. The valve outlet 155 of the mixing valve 130 directs the water toward the heating system 135.

In the illustrated embodiment, the output loop 115, also referred to as the domestic water loop 115, provides cold inlet water to the heat exchanger 105 and provides hot water to a consumer. As shown in FIG. 1, the output loop 115 includes a cold water inlet 170, a hot water outlet 175, a circulation pump 180, a first sensor 185, and a second sensor 190. The cold water inlet 170 provides cold water to the output loop 115 from, for example, a cold water reservoir such as a well or a city water system. The cold water then enters the heat exchanger 105 at the second inlet 127 of the heat exchanger 105, and exits the heat exchanger 105 as hot water at the second outlet 129 of the heat exchanger 105. The hot water outlet 175 provides hot water to the consumer.

The circulation pump 180 circulates the water from the output loop 115 continuously. The circulation pump 180 is coupled between the cold water inlet 170 and the hot water outlet 175, and circulates the water from the hot water outlet 175 back to the heat exchanger 105. When there is no draw of hot water at the hot water outlet 175, the water in the output loop 115 continues to loop through the heat exchanger 105 without the need to add water from the cold water inlet 170 to the water directed to the heat exchanger 105. Therefore, when there is no draw of hot water at the hot water outlet 175, the temperature of the water at the second inlet 127 of the heat exchanger 105 is approximately the same as the temperature of the water at the hot water outlet 175 (since it is the same water from the hot water outlet 175 going into the second inlet 127 of the heat exchanger 105). When, however, there is a water draw at the hot water outlet 175, some of the water from the cold water inlet 170 is directed to the second inlet 127 of the heat exchanger 105. The higher the water draw at the hot water outlet 175, the more cold water from the cold water inlet 170 that is directed to the heat exchanger 105.

The first sensor 185 is positioned between the circulation pump 180 and the second inlet 127 of the heat exchanger 105. The first sensor 185 includes a temperature sensor and provides an indication of the sensed water temperature at the second inlet 127 of the heat exchanger 105. That is, the first sensor 185 outputs a temperature signal indicative of an input temperature at the second inlet 127 of the heat exchanger 105. The temperature sensor may be any variety of temperature sensors, including but not limited to, resistance temperature detectors, thermocouples, thermistors, thermostats, and the like. As discussed above, cold water enters the heat exchanger 105 at the second inlet 127 when there is a water draw at the hot water outlet 175. Since the first sensor 185 measures a water temperature at the second inlet 127 of the heat exchanger 105, the first sensor 185 provides an approximate measure of the water draw at the hot water outlet 175. The second sensor 190 also includes a temperature sensor. In some embodiments, the temperature sensor of the second sensor 190 is substantially similar to the temperature sensor of the first sensor 185. The second sensor 190 is positioned between the second outlet 129 of the heat exchanger 105 and the circulation pump 180. In this position, the second sensor 190 provides an indication of the sensed water temperature at the second outlet 129 of the heat exchanger 105. That is, the second sensor 190 outputs a temperature signal indicative of an output temperature at the second outlet 129 of the heat exchanger 105. As discussed above, the water temperature at the hot water outlet 175 is ideally maintained at the user-defined setpoint. Since the second sensor 190 measures a water temperature at the second outlet 129 of the heat exchanger 105, the second sensor 190 provides an indication of whether the water at the hot water outlet 175 is at the setpoint.

Figure 3:
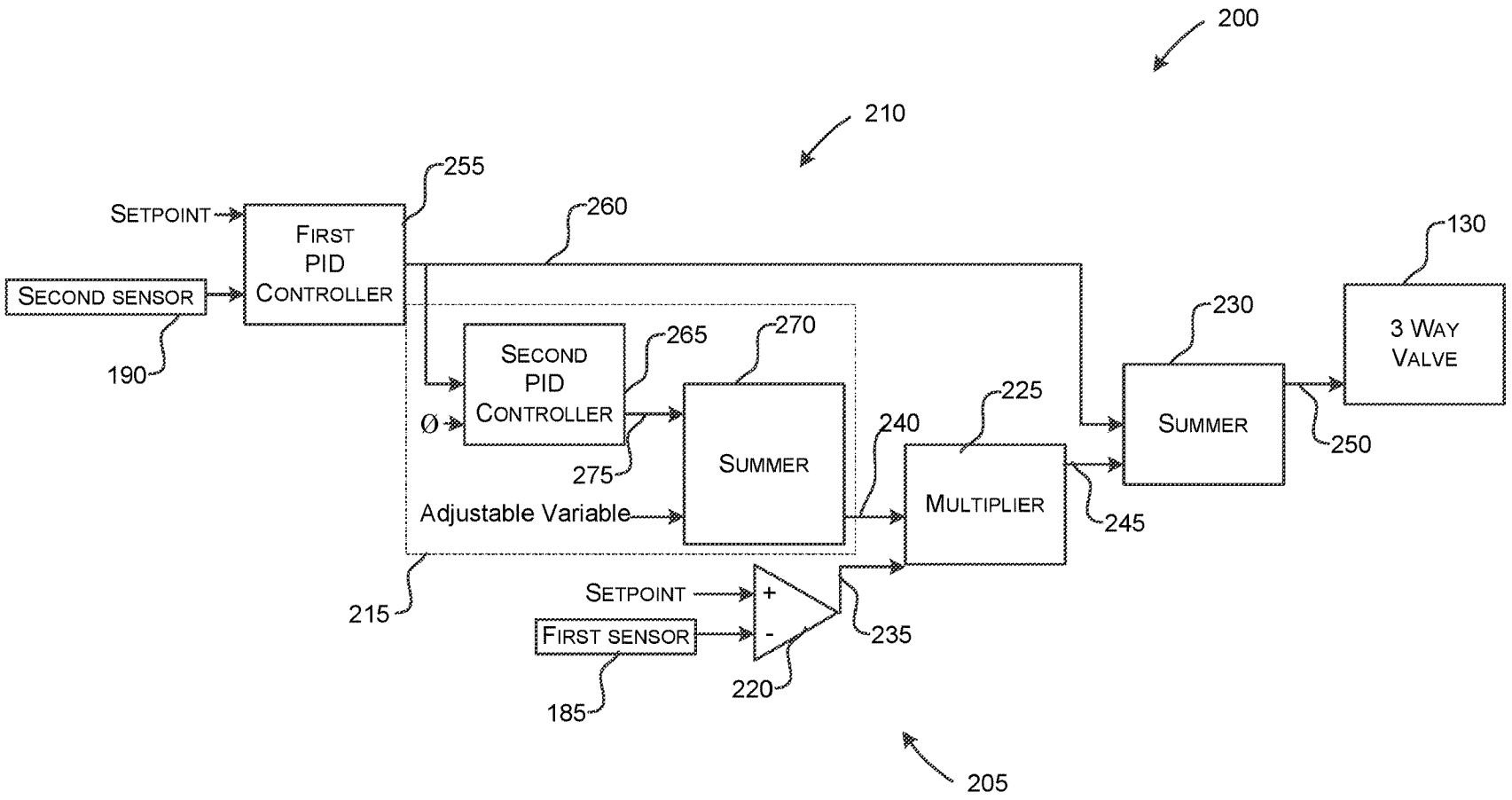
FIG. 3 is a block diagram of a control circuit of the water heating system of FIG. 1.

The first and second sensors 185, 190 are coupled to a control circuit 200 shown in FIG. 3. The control circuit 200 is coupled to the mixing valve 130 to control the position of the mixing valve 130 such that the temperature of the water at the hot water outlet 175 is maintained at the setpoint. The control circuit 200 of the illustrated embodiment includes a feed-forward loop 205, a feedback loop 210, and a multiplying factor determining circuit 215. The feed-forward loop 205 determines when a water draw occurs at the hot water outlet 175, and sends a signal to the mixing valve 130 to change position before there is a change in water temperature at the hot water outlet 175. The feed-forward loop 205 includes the first sensor 185, a differentiator 220, a multiplier 225, and a first adder 230. The first sensor 185 is coupled to the differentiator 220. The differentiator 220 generates a difference signal 235 based on the temperature signal from the first sensor 185. The difference signal 235 corresponds, or is based on, the difference between the temperature signal from the first sensor 185 and the setpoint temperature. The difference between the temperature signal from the first sensor 185 and the setpoint temperature indicates how much heat may be needed to compensate for the hot water draw. This difference signal is therefore used as the basis to control the position of the mixing valve 130. The differentiator 220 is coupled to the first sensor 185 and the multiplier 225. The differentiator 220 sends the difference signal 235 to the multiplier 225. The multiplier 225 is coupled to the differentiator 220, the multiplying factor determining circuit 215, and the first adder 230. The multiplier 225 receives a multiplying factor 240 from the multiplying factor determining circuit 215, and generates a primary control signal 245. The primary control signal 245 includes a product of the multiplying factor 240 and the difference signal 235. The multiplier 225 then sends the primary control signal 245 to the first adder 230. The first adder 230 is coupled to the multiplier 225 and to the feedback loop 210. The first adder 230 generates a control signal 250 based at least on the primary control signal 245. The mixing valve 130 receives the control signal 250 and changes its position based on the control signal 250.

The feedback loop 210 includes the second sensor 190, a first PID (proportional, integral, derivative) controller 255, and the first adder 230. The second sensor 190 is coupled to the first PID controller 255 and provides the first PID controller 255 with a sensed water temperature at the second outlet 129 of the heat exchanger 105. The first PID controller 255 generates a secondary control signal 260 based on a comparison of the setpoint temperature and the sensed temperature at the second outlet 129 of the heat exchanger 105. The first PID controller 255 then sends the secondary control signal 260 to the first adder 230. As discussed above, the first adder 230 generates the control signal 250 based on the primary control signal 245 and the secondary control signal 260.

The multiplying factor determining circuit 215 determines (e.g., calculates) the multiplying factor 240 used by the multiplier 225 of the feed-forward loop 205. The multiplier determining circuit 215 is coupled between the feedback loop 210 and the feed-forward loop 205, and more specifically, between the feedback loop 210 and the multiplier 225. In the illustrated embodiment, the multiplying factor determining circuit 215 includes a second PID controller 265 and a second adder 270. The second PID controller 265 receives the secondary control signal 260 from the first PID controller 255, and generates an error signal 275. The second PID controller 265 is coupled to the second adder 270 and sends the error signal 275 to the second adder 270. The second adder 270 is coupled to the second PID controller 265 and the multiplier 225. The second adder 270 generates the multiplying factor 240 based on the secondary control signal 260 and an adjustable variable (further discussed below), and sends the multiplying factor 240 to the multiplier 225.

Figure 4:
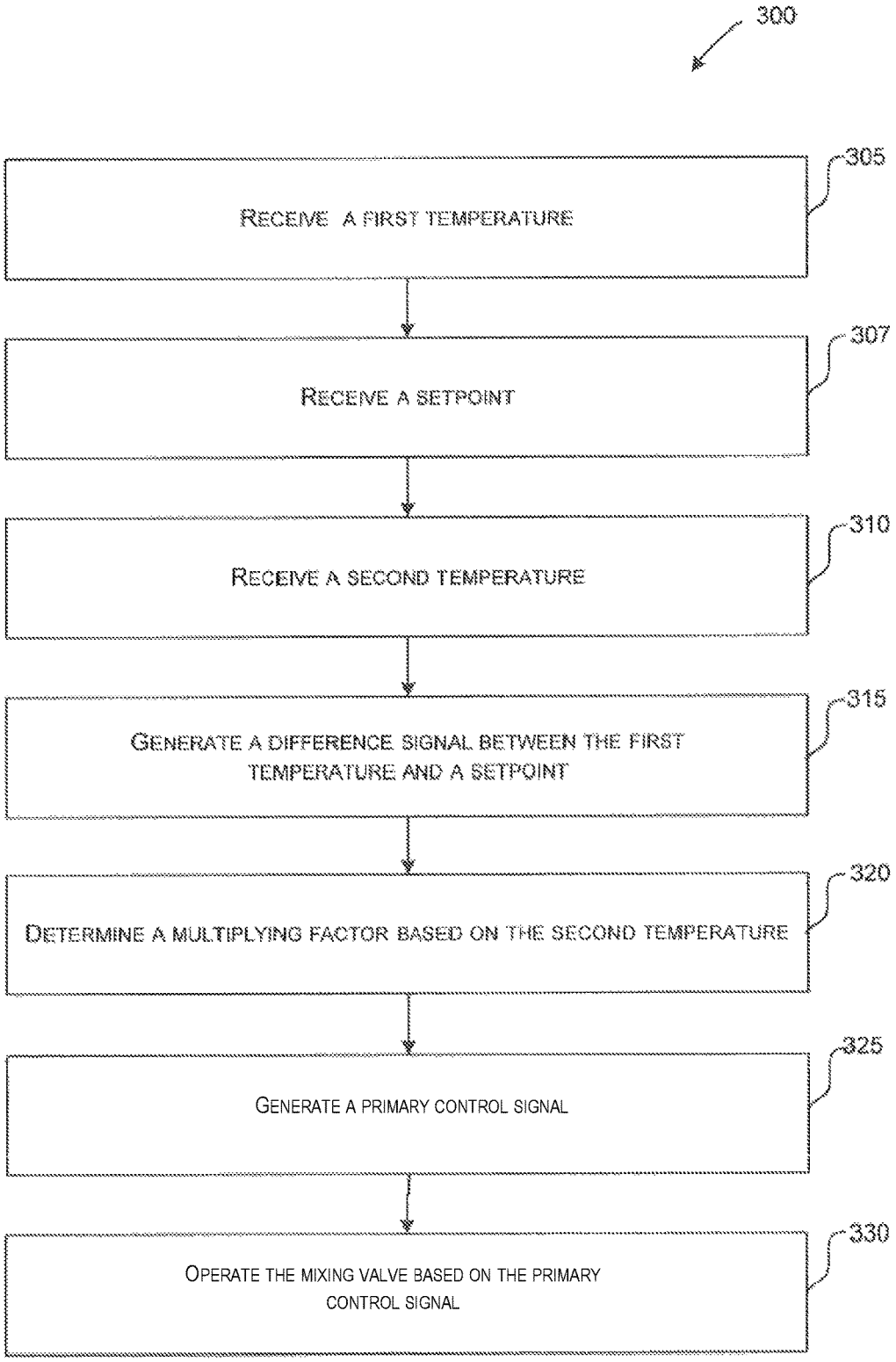
FIG. 4 is a flowchart illustrating a method of operating the water heating system of FIG. 1 according to some embodiments of the application.

FIG. 4 is a flowchart illustrating a method 300 of operation of the control circuit 200 to change a position of the mixing valve 130. First, the differentiator 220 receives a first temperature from the first sensor 185 (block 305). The first temperature corresponds to a sensed water temperature at the second inlet 127 of the heat exchanger 105 from the first sensor 185. The differentiator 220 also receives a setpoint (block 307). As discussed above, in some embodiments, the setpoint may be a user-defined setpoint. In such embodiments, the water heating system 100 may include a user interface (e.g., physical and/or virtual actuators) to receive an indication of the setpoint. The control circuit 200, and more specifically, the first PID controller 255 also receives a second temperature from the second sensor 190 (block 310). The second temperature corresponds to a sensed water temperature at the second outlet 129 of the heat exchanger 105. The differentiator 220 then generates the difference signal 235 between the first temperature and the setpoint (block 315). Monitoring the difference between the first temperature and the setpoint allows the control circuit 200 to detect when a water draw begins to occur. Using the difference signal 235 to control the position of the mixing valve 130 enables the control circuit 200 to change the position of the mixing valve 130 before the water temperature at the hot water outlet 175 decreases due to the water draw.

After generating the difference signal 235, the multiplying factor determining circuit 215 determines the multiplying factor 240 based on the second temperature (block 320). The multiplier 225 then generates the primary control signal 245 (block 325). The multiplier 225 generates the primary control signal 245 by multiplying the difference signal 235 with the multiplying factor 240. Multiplying the difference signal 235 and the multiplying factor 240 allows the control circuit to more accurately change the position of the mixing valve 130 based on the difference signal 235. The multiplying factor 240 provides a scaling factor to determine how much change in position of the mixing valve 130 corresponds to the difference signal 235. The control circuit 200 then operates the mixing valve 130 (e.g., changes the position of the mixing valve 130) based on the modified multiplier signal (block 330).

Figure 5:
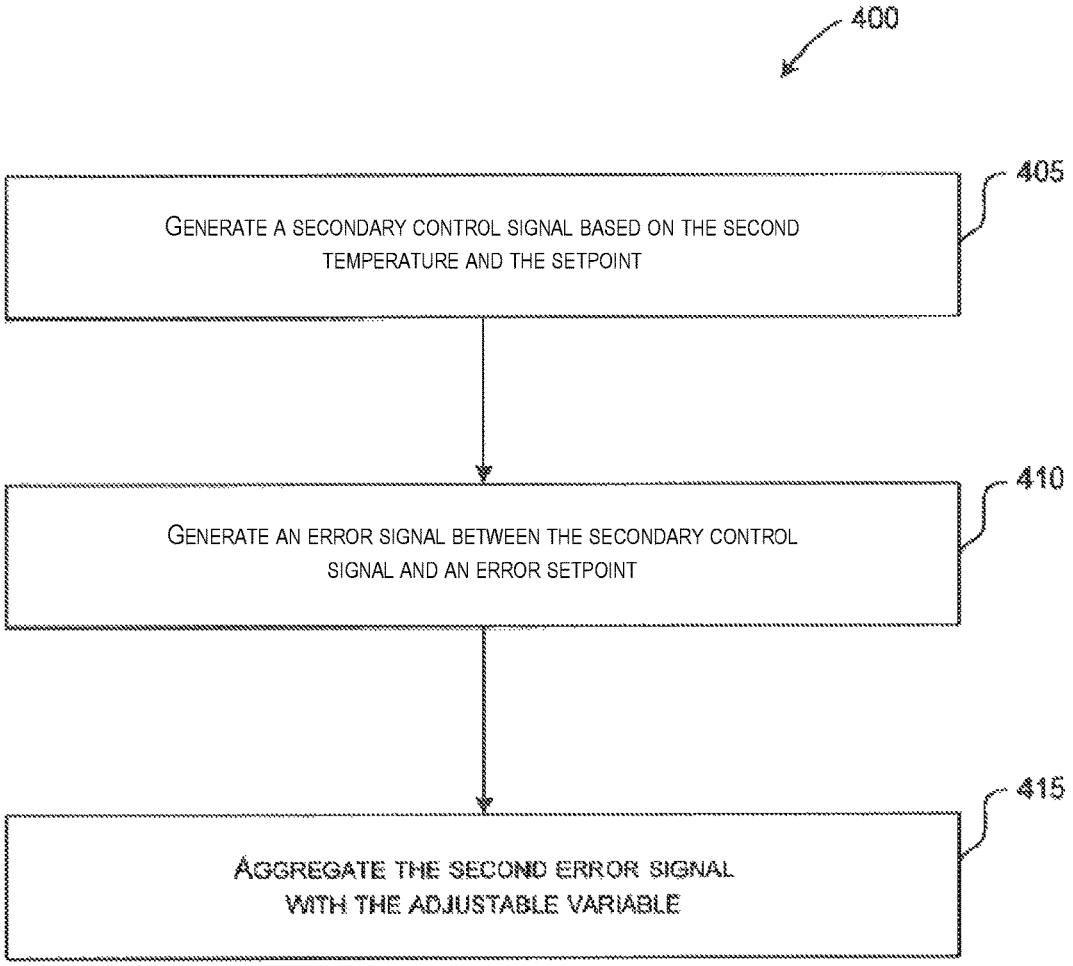
FIG. 5 is a flowchart illustrating a method of determining a multiplier value for the water heating system of FIG. 1 according to some embodiments of the application.

FIG. 5 is a flowchart illustrating a method 400 of determining the multiplying factor 240. First, the first PID controller 255 generates the secondary control signal 260 between the second temperature and the setpoint (block 405). The first PID controller 255 determines when the water temperature at the hot water outlet 175 is below or above the user-defined setpoint. The second PID controller 265 then generates the error signal 275 between the first error signal and an error threshold (block 410). The error threshold corresponds to the allowable variation in the water temperature at the hot water outlet 175 with respect to the setpoint. In the embodiment shown in FIG. 3, the error threshold corresponds to zero. In other words, the water temperature at the hot water outlet 175 is expected to be at the setpoint. Therefore, the error signal 275 indicates how different the water temperature at the hot water outlet 175 is from the setpoint. When the multiplying factor 240 is ideal, the feed-forward loop 205 anticipates the position change necessary at the mixing valve 130 to maintain the water temperature at the hot water outlet 175 at the setpoint. In these instances the secondary control signal 260 is approximately zero, and thus the second PID controller 265 determines no difference between the secondary control signal 260 and the zero error threshold.

The second adder 270 then aggregates (e.g., adds) the error signal and an adjustable variable to generate the multiplying factor 240 (block 415). The adjustable variable is a variable that changes according to the setpoint. In other words, the adjustable variable is a function of the setpoint. In one embodiment, the adjustable variable is calculated by the following equation:

$$\text{Adjustable Variable} = \frac{(210^\circ\ \text{F.} - \text{Setpoint})}{\text{Setpoint}}$$

However, in other embodiments, the adjustable variable may be calculated in a different manner, for example but not limited to, using a second equation shown below:

$$\text{Adjustable Variable} = \left(\frac{240}{\text{Setpoint} + 25}\right) - 1$$

Still in other embodiments, the adjustable variable may be determined using different methods. In some embodiments, the equation used to calculate the adjustable variable is determined empirically by testing different setpoints, multipliers, and equations.

Figure 6:
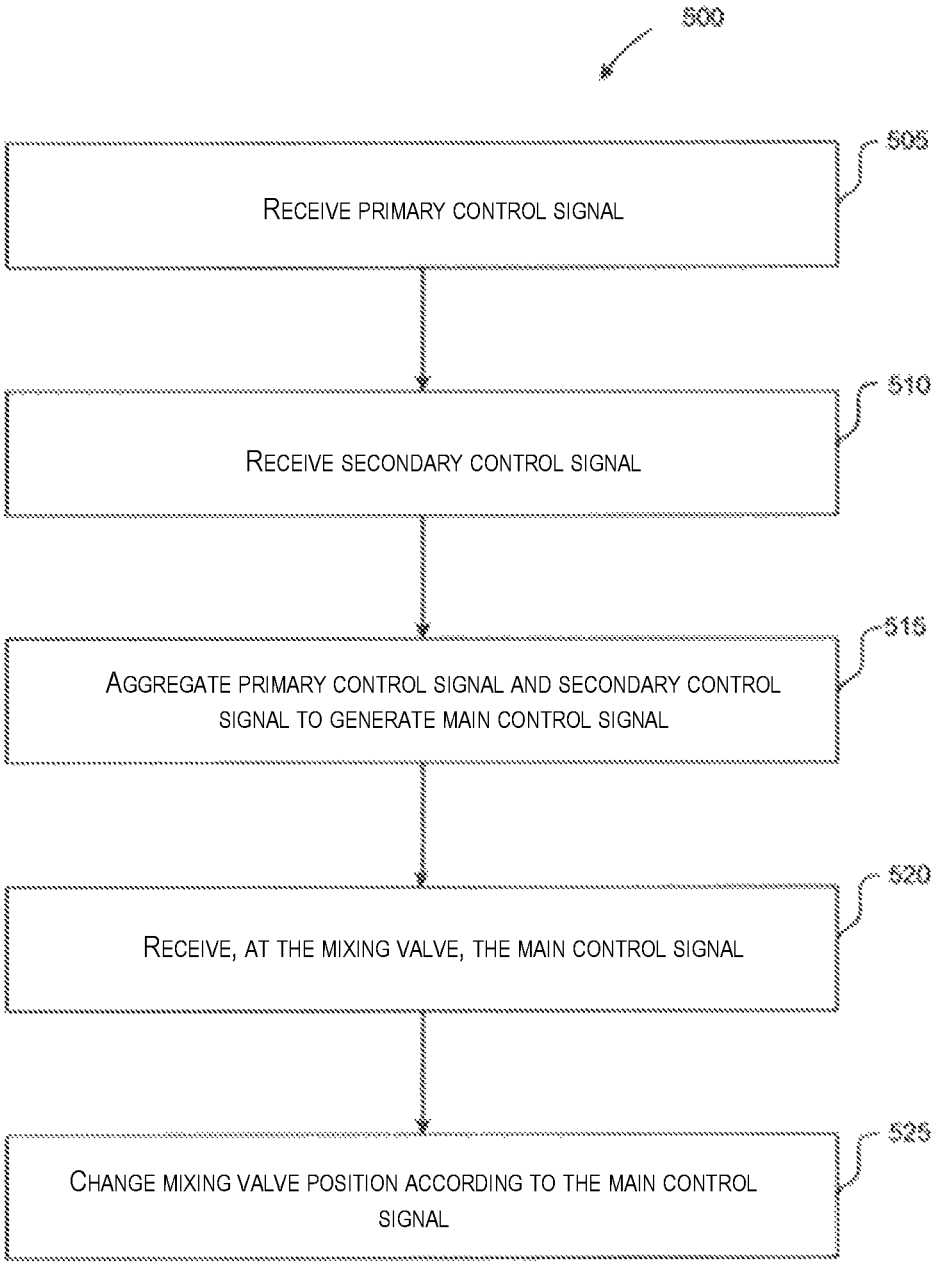
FIG. 6 is a flowchart illustrating a method of operating a mixing valve of the water heating system of FIG. 1 based on a modified multiplier signal according to some embodiments of the application.

FIG. 6 is a flowchart illustrating a method 500 of operating the mixing valve 130 based on the primary control signal 245. First, the first adder 230 receives the primary control signal 245 (block 505). The first adder 230 also receives the secondary control signal 260 from the feedback loop 210 (block 510). The first adder 230 then aggregates (e.g., adds) the primary control signal 245 and the secondary control signal 260 to generate the control signal 250 (block 515). The mixing valve 130 then receives the control signal 250 from the first adder 230 (block 520) and changes its position according to the control signal 250 (block 525). In other words, the mixing valve 130 changes its operation in response to receiving the control signal 250 and based on the control signal 250. Therefore, the mixing valve 130 changes its position based on both the primary control signal 245 and the secondary control signal 260. Taking into account both the water temperature at the second inlet 127 of the heat exchanger 105 and the water temperature at the second outlet 129 of the heat exchanger 105 provides a more precise and accurate control of the position of the mixing valve.

Figure 7:
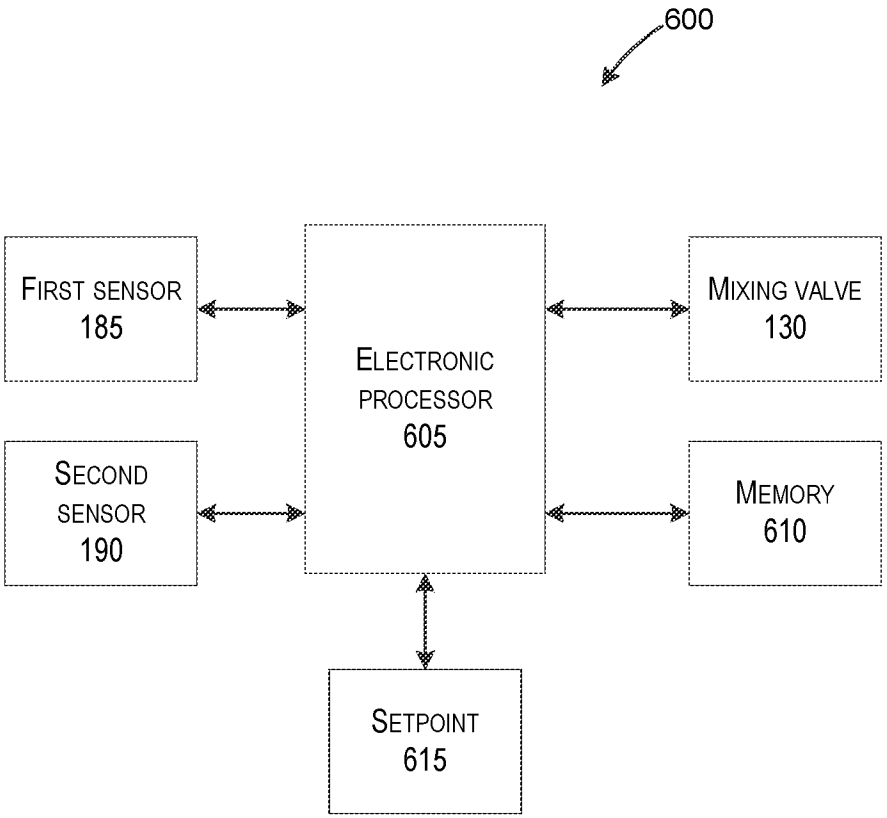
FIG. 7 is a block diagram of an implementation of the control circuit of FIG. 3 using an electronic processor.

Although the steps for the flowcharts above have been described as being performed serially, in some embodiments, the steps may be performed in a different order and two or more steps may be carried out in parallel to, for example, expedite the control process. Additionally, although the control circuit 200 is shown in FIG. 3 as including two PID controllers 255, 265, two adder circuits 230, 270, and other components, in some embodiments, the control circuit 200 may be implemented using an electronic processor. FIG. 7 illustrates an example of the implementation 600 of the control circuit 200 with an electronic processor. In the illustrated example, the implementation 600 includes an electronic processor 605, a memory 610, the first sensor 185, the second sensor 190, and the mixing valve 130. The electronic processor 605 of the illustrated example, implements the functionality of the first PID controller 255, the second PID controller 265, the first adder 230, the second adder 270, the multiplier 225, and the differentiator 220. To implement such functionality, the electronic processor 605 may execute instructions from software. As shown in FIG. 7, the electronic processor 605 is coupled to the first sensor 185 to receive an indication of the water temperature at the second inlet 127 of the heat exchanger 105. The electronic processor 605 is also coupled to the second sensor 190 to receive an indication of the water temperature at the second outlet 129 of the heat exchanger 105. Additionally, the electronic processor 605 receives an indication of the user-defined setpoint 615. When the control circuit 200 is implemented with the electronic processor 605, the electronic processor 605 executes the methods described with respect to FIGS. 4-6. Additionally, the electronic processor 605 may access the memory 610 to retrieve specific set points or formulas for calculating a specific variable, such as the adjustable variable used by the second adder 270.

Figure 8:
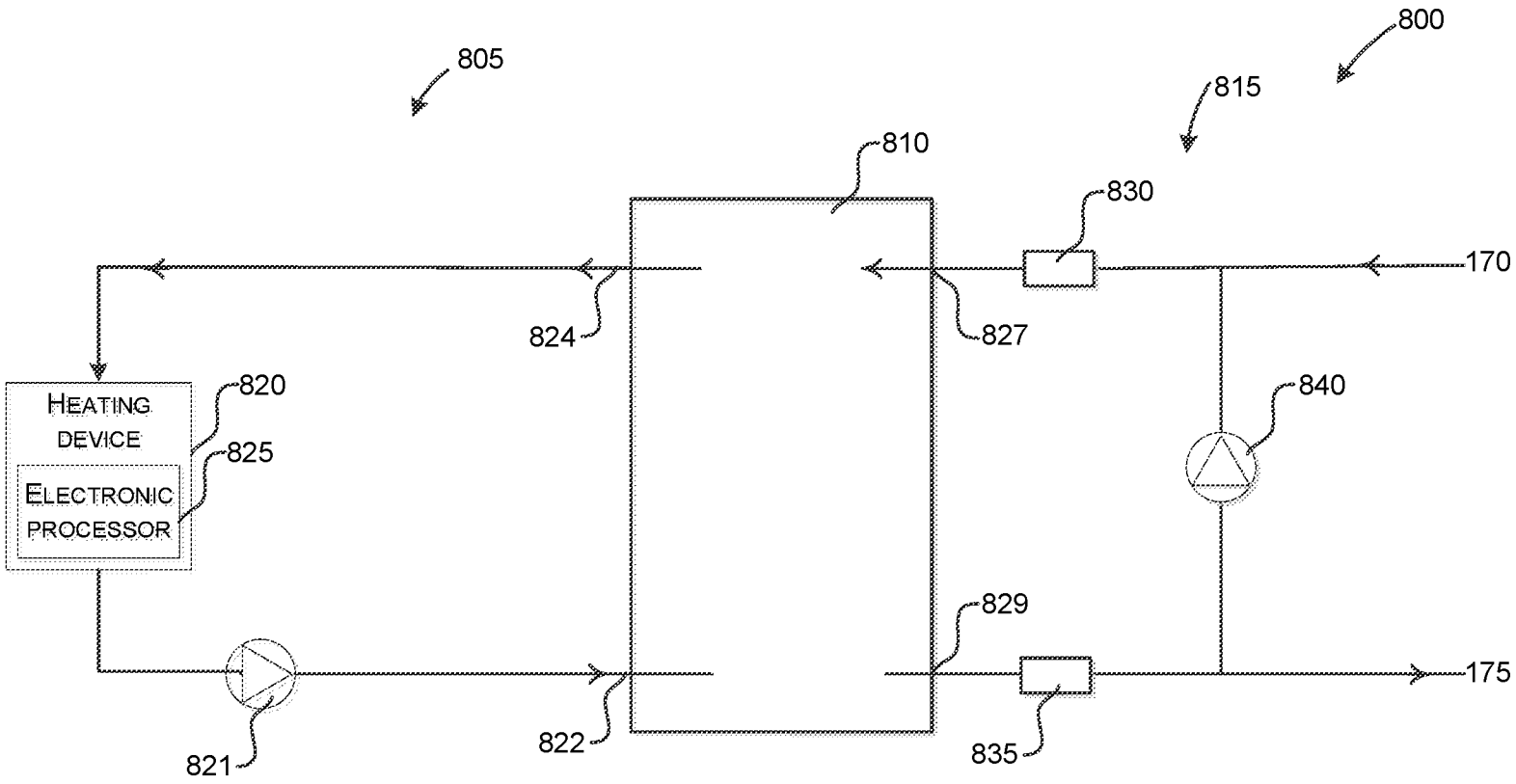
FIG. 8 is a schematic diagram of another water heating system according to another embodiment of the application.

FIG. 8 illustrates another exemplary embodiment of a water heating system 800. As shown in FIG. 8, the water heating system 800 includes a water supply subsystem 805, an intermediary water device 810, and a water output subsystem 815. The water supply subsystem 805 includes a heating device 820 including a control device 825 for the water supply subsystem, and a pump 821. The pump 821 operates similar to the pump 140, and directs water to the intermediary device 810. In the illustrated embodiment, the control device 825 includes an electronic processor included as part of the heating device 820 and controls operation of the heating device 820. The heating device 820 may include, for example, a commercial or residential water heater. The heating device 820 receives water from the water supply subsystem 805, heats the water, and sends heated water to the intermediary device 810.

In the illustrated embodiment, the intermediary device 810 includes a buffer water tank. The buffer water tank 810 receives heated water from the water supply subsystem 805 and maintains the heater water near a desired setpoint (for example, a setpoint received from a user input). Similar to the heat exchanger 105 of FIG. 1, the intermediary device 810 includes a first input 822 to receive water from the water supply subsystem 805, a first output 824 to return water back to the water supply subsystem 805, a second input 827 to receive return water from the water output subsystem 815, and a second output 829 to output heated water to the water output subsystem 815. The water output system 815 includes a first temperature sensor 830, a second temperature sensor 835, and a recirculation pump 840. The water output subsystem 815 receives heated water from the intermediary device 810 via the second output 829 and returns unused water to the intermediary device 810 at the second input 827.

Figure 9:
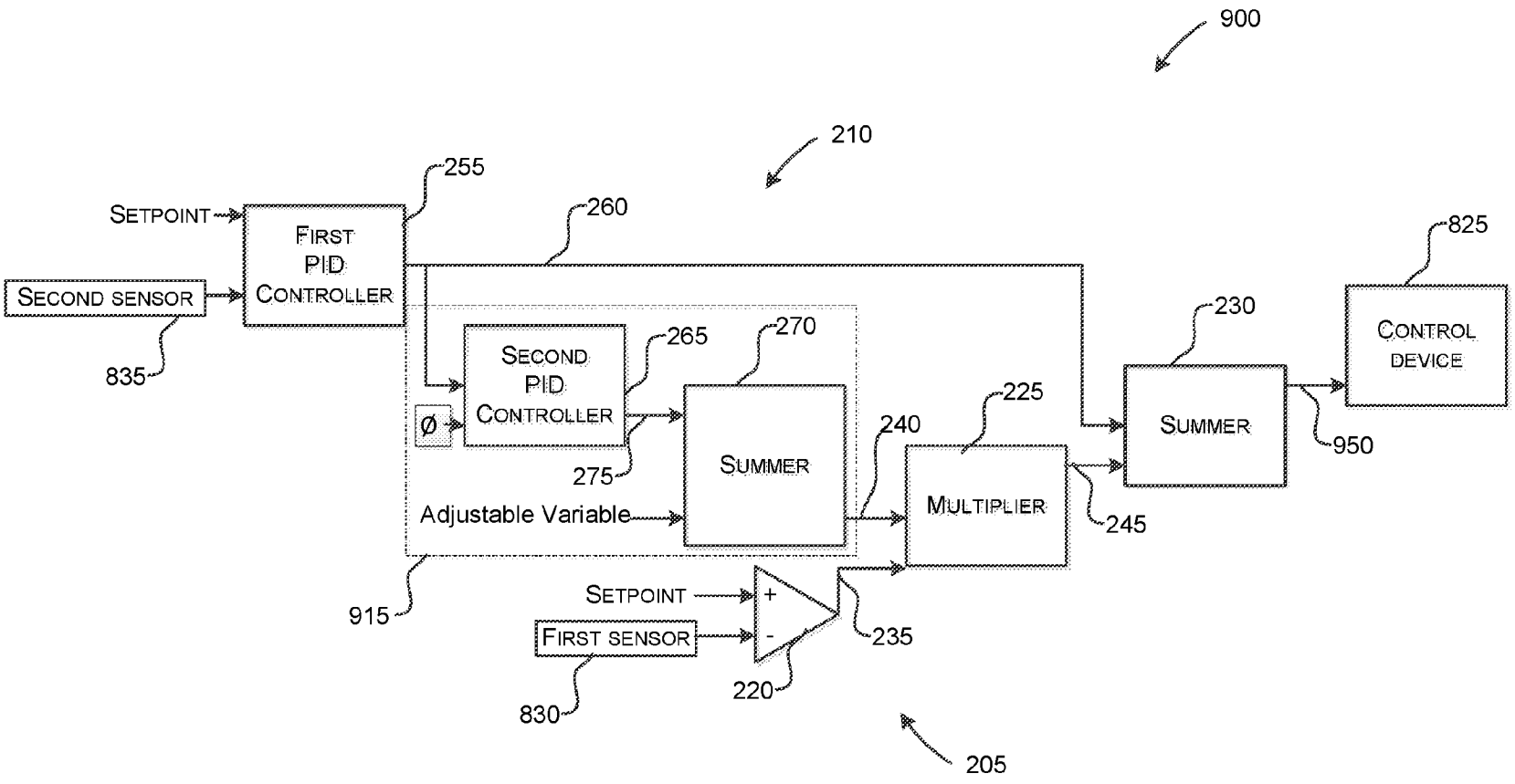
FIG. 9 is a block diagram of a control circuit of the water heating system of FIG. 8.

The water heating system 800 may operate similar to the water heating system 100 described with reference to FIGS. 1-7. In particular, the water heating system 800 may also includes a control circuit 900 similar to the control circuit 200 shown in FIG. 3. FIG. 9 illustrates the control circuit 900 according to some embodiments. The control circuit 900 may include similar components as the control circuit 200 of FIG. 3 and similar elements have been given the same reference numbers plus 700. As shown in FIG. 9, the main control signal 950 instead of being directed to a mixing valve 130 as shown in FIG. 3 is directed to the control device 825. That is, the main control signal 950 is sent to the electronic processor 825 of the heating device 820. In some embodiments, an intermediary control device is positioned between the control circuit 900 and the electronic processor 825 of the heating device 820 to translate the main control signal to a control signal expected by the electronic processor 825 of the heating device 820. The electronic processor 825 then changes operation of the heating device 820 based on the received main control signal 950.

In some embodiments, the electronic processor 825 activates and/or deactivates the heating elements of the heating device 820 (for example, when the heating device 820 is an electric water heater) in response to receiving the main control signal 950 (and in accordance with the main control signal 950). For example, the electronic processor 825 sends an activation signal to one or more heating elements when the main control signal 950 indicates that water in the water output subsystem 815 has fallen (or is falling) below the desired setpoint. Analogously, the electronic processor 825 may activate and/or deactivate a burner when the heating device is a gas-fired heating device 820. In some embodiments, the heating device 820 may include, for example, a condensing water heater for which a firing rate may be regulated. For example, the electronic processor 825 may regulate a firing rate of the heating device 820 to match the current demand for heated water. In some embodiments, the electronic processor 825 may regulate the firing rate between approximately 10% to a maximum of approximately 100%. In such embodiments, the electronic processor 825 receives the main control signal 950 from the control circuit 900 and adjusts the firing rate of the heating device 820 based on the main control signal 950. That is, the electronic processor 825 may increase the firing rate of the heating device 820 and/or reduce the firing rate of the heating device 820.

The invention claimed is:

1. A fluid heating system comprising:

a fluid supply subsystem including a fluid heating device, a fluid output subsystem;

an intermediary fluid device coupled to the fluid supply subsystem and the fluid output subsystem, the intermediary fluid device including:

a heat exchanger, a first input configured to receive fluid from the fluid supply subsystem, a first output configured to output fluid to the fluid supply subsystem, a second input configured to receive fluid from the fluid output subsystem, a second output configured to output fluid to the fluid output subsystem;

a control device including:

a mixing valve including a first valve inlet configured to receive fluid from the first output of heat exchanger, a second valve inlet configured to receive fluid from the fluid supply subsystem, and a valve outlet, wherein the mixing valve is movable between a first position in which the valve outlet is in fluid communication with the first valve inlet, and a second position in which the valve outlet is in fluid communication with the second valve inlet, and an electronic processor for the fluid supply subsystem, the electronic processor configured to control at least one selected from the group consisting of the fluid heating device and an amount of water input to the intermediary fluid device;

a first temperature sensor configured to output a first temperature signal corresponding to an input temperature of water at the second input of the intermediary fluid device;

a second temperature sensor configured to output a second temperature signal corresponding to an output temperature of water at the second output of the intermediary fluid device; and a control circuit coupled to the electronic processor, the first temperature sensor, and the second temperature sensor, the control circuit configured to:

determine a multiplier based on the second temperature signal, generate a first control signal based on the multiplier and the first temperature signal, generate a second control signal, separate from the first control signal, based on the second temperature signal, and send a main control signal to the electronic processor based on the first control signal and the second control signal;

wherein the electronic processor is configured to receive the main control signal, and change operation of the control device according to the main control signal.

2. The fluid heating system of claim 1, wherein the mixing valve changes to the first position based on the main control signal.

3. The fluid heating system of claim 1, wherein the intermediary fluid device includes a buffer tank.

4. The fluid heating system of claim 1, wherein the electronic processor activates a heating element of the fluid heating device in response to the main control signal.

5. The fluid heating system of claim 1, wherein the second control signal is based on a comparison of the second temperature signal with a setpoint.

6. The fluid heating system of claim 1, wherein the control circuit is configured to generate a difference signal corresponding to a difference between the first temperature signal and a setpoint, and wherein the first control signal is based on the difference signal.

7. The fluid heating system of claim 6, wherein the first control signal is based on a product of the multiplier and the difference signal.

8. The fluid heating system of claim 7, wherein the control circuit is configured to determine the multiplier based on an adjustable variable, the adjustable variable being based on the setpoint.

9. A method of controlling a fluid heating system, the method comprising:

receiving, fluid from a fluid supply subsystem at a first input of an intermediary fluid device;

receiving fluid from a fluid output subsystem at a second input of the intermediary fluid device, the fluid supply subsystem including a fluid heating device;

outputting fluid to the fluid supply subsystem at a first output of the intermediary fluid device;

outputting fluid to the fluid output subsystem at a second output of the intermediary fluid device;

receiving, at a control circuit, a first temperature signal from a first temperature sensor, the first temperature signal corresponding to an input temperature of water at the second input of the intermediary fluid device;

receiving, at the control circuit, a second temperature signal from a second temperature sensor, the second temperature signal corresponding to an output temperature of water at the second output of the intermediary fluid device;

determining, with the control circuit, a multiplier based on the second temperature signal;

generating, with the control circuit, a first control signal based on the multiplier and the first temperature signal;

generating, with the control circuit, a second control signal, separate from the first control signal, based on the second temperature signal, sending a main control signal to an electronic processor of a control device for the fluid supply subsystem based on the first control signal and the second control signal, the electronic processor configured to control at least one selected from the group consisting of the fluid heating device and an amount of water input to the intermediary fluid device; and changing, via the electronic processor, operation of the control device based on the main control signal in response to receiving the main control signal at the control device wherein the intermediary fluid device includes a heat exchanger, and wherein changing operation of the control device includes controlling a position of a mixing valve between a first position in which a valve outlet of the mixing valve is in fluid communication with the first output of the intermediary fluid device, and a second position in which the valve outlet of the mixing valve is in fluid communication with the fluid supply subsystem.

10. The method of claim 9, wherein generating the second control signal includes generating the second control signal based on a comparison of the second temperature signal and a setpoint.

11. The method of claim 9, wherein generating the first control signal includes generating, with the control circuit, a difference signal corresponding to a difference between the first temperature signal and a setpoint.

12. The method of claim 11, wherein generating the first control signal further includes calculating, with the control circuit, a product of the multiplier and the difference signal.

13. The method of claim 12, wherein determining the multiplier includes:

determining, with the control circuit, an adjustable variable, the adjustable variable being based on the setpoint, and determining, with the control circuit, the multiplier based on the second temperature signal and the adjustable variable.

14. The method of claim 11, wherein the control device includes a mixing valve and the intermediary fluid device includes a heat exchanger, and further comprising moving the mixing valve, when the difference signal is approximately zero, from a first position in which a valve outlet of the mixing valve is in fluid communication with the first output of the heat exchanger, to a second position in which the valve outlet of the mixing valve is in fluid communication with the fluid supply subsystem.

15. The method of claim 9, wherein changing the operation of the control device includes generating an activation signal for a heating element of the fluid heating device in response to receiving the main control signal at the electronic processor.

16. The method of claim 9, wherein changing the operation of the control device includes changing a firing rate of the fluid heating device in response to receiving the main control signal at the electronic processor.

17. The method of claim 9, wherein receiving fluid from the fluid output subsystem includes receiving fluid from the fluid output subsystem at an input of a buffer water tank.

* * * * *